US006547670B1

(12) United States Patent
Kempf

(10) Patent No.: US 6,547,670 B1
(45) Date of Patent: Apr. 15, 2003

(54) STAGE ELEMENT MOVEMENT ASSEMBLY

(75) Inventor: James D. Kempf, Newburgh, NY (US)

(73) Assignee: Production Resource Group L.L.C., New Windsor, NY (US)

( * ) Notice: Subject to any disclaimer, the term of this patent is extended or adjusted under 35 U.S.C. 154(b) by 0 days.

(21) Appl. No.: 10/156,208

(22) Filed: May 28, 2002

(51) Int. Cl.[7] ..... A63J 1/02
(52) U.S. Cl. ..... 472/77; 472/78; 472/80
(58) Field of Search ..... 472/75, 76, 77, 472/78, 79, 80, 81, 136

(56) References Cited

U.S. PATENT DOCUMENTS

| | | | | | |
|---|---|---|---|---|---|
| 1,772,661 | A | * | 8/1930 | Fredericks | 472/77 |
| 2,182,757 | A | | 12/1939 | Gilbert | |
| 2,602,196 | A | | 7/1952 | Pelton | |
| 3,558,102 | A | | 1/1971 | Cruse | |
| 4,090,692 | A | * | 5/1978 | Jacobs | 472/78 |
| 4,324,386 | A | * | 4/1982 | Gagnon et al. | 254/288 |
| 4,392,648 | A | * | 7/1983 | Foy | 472/80 |
| 4,606,527 | A | * | 8/1986 | Ziller et al. | 254/336 |
| 4,662,628 | A | * | 5/1987 | Chatenay epouse Compagnone | 472/77 |
| 5,194,047 | A | * | 3/1993 | Cabell | 472/75 |
| 5,350,055 | A | | 9/1994 | Lecrone | |
| 6,068,556 | A | * | 5/2000 | Bernstein | 472/77 |
| 6,260,690 | B1 | | 7/2001 | Batzer | |

* cited by examiner

*Primary Examiner*—Kien T. Nguyen

(57) ABSTRACT

A stage element movement assembly includes a first cable in a tunnel below the stage deck and extending in a first path in a first direction. A first dog is secured to the first cable for movement therewith in the tunnel, and an engagement member is engaged with the first dog and will extend upwardly through a slot in the stage deck for engagement with the stage deck for engagement with the stage element to be moved. A second cable is provided for disposition in a tunnel below the stage deck in a second path in a direction at an angle to the direction of the first cable and crosses below the first cable. Linearly spaced cable guide rollers on opposite sides of the cable crossing cause the cable to move downwardly to pass below the first cable and thereafter be moved upwardly to the plane of its original path. Engagement elements are secured to the cable in spaced relationship and a crossing dog having spaced engagement elements are engaged with the engagement elements on the second cable. The leading engagement element disengages from the crossing dog as the second cable is moved downwardly while the trailing engagement element remains engaged until it is moved downwardly. At this point, the leading engaging element reengages the crossing dog. An engagement member engaged with the crossing dog extends upwardly through a slot in the stage deck for engagement with a stage element to be moved, and power driven winches move the cables and thereby the stage elements.

15 Claims, 9 Drawing Sheets

STAGE ELEMENT MOVEMENT ASSEMBLY

BACKGROUND OF THE INVENTION

The present invention relates to stage construction and more particularly to stage installations providing remote controlled movement of stage elements such as scenery, furniture and the like.

For theatrical productions, it is common to have a temporary floor containing mechanical systems to move scenery laterally, vertically, and rotationally within the stage area. These floors are known as show decks and are often six to twelve inches high and rest directly on the permanent stage floor of a venue. Within a show deck the most common means for moving rolling scenic units laterally across the floor are winch driven tracks. Deck tracks regularly consist of a ⅜" slot in the deck surface under which a steel block known as a dog travels in a tunnel built into the show deck. The scenic unit connects to the dog with a ¼" wide vertical steel bar known as a knife that passes through the ⅜" slot in the floor surface and is captured in the dog. The dog is then pulled through the tunnel by a continuous loop of aircraft cable that spools on and off of an electric winch near or below the show deck.

The main drawback of cable driven tracks is the inability to cross them. This problem has existed since the Italians developed rope driven deck tracks in the sixteenth century. The dog in one tunnel will always collide with the permanent cables in the intersecting track tunnel, which are always present regardless of the location of the intersecting dog or scenic unit is located along its travel path. As theatrical designers lay out the show decks to coordinate how the scenery moves and stores, they are often frustrated by the challenge of keeping each track separate. In most cases they compromise their design intent to accommodate the physical realities and this results in less functionality and artistic impact than ultimately desired.

In recent years, there have been several attempts to mitigate the problem by combining standard cable driven tracks with other technologies. These alternates include friction driven scenic units which have positioning and cable management problems, and push chain driven tracks which have noise problems and excessive costs.

It is the object of the present invention to provide a novel stage element movement assembly for location below the surface of the stage deck which permits crossing tracks for the movement of multiple stage elements.

It is also an object to provide such an assembly which can be fabricated relatively simply, installed relatively quickly and operated efficiently to move stage elements in different directions which cross.

Another object is to provide a novel stage installation containing such a novel movement assembly which enables movement of multiple stage element through the same stage area.

SUMMARY OF THE INVENTION

It has now been found that the foregoing and related objects may be readily attained in a stage element movement assembly for location below the surface of a stage deck and a first cable for disposition in a tunnel below the stage deck and extending in a first path in a first direction. A first dog is secured to the first cable for movement therewith in the tunnel, and an engagement member is engaged with the first dog and adapted to extend upwardly through a slot in the stage deck for engagement with the stage element to be moved. A power driven winch is provided for moving the first cable and first dog in the first path.

A second cable is provided for disposition in a tunnel below the stage deck extending in a second path in a direction at an angle to the direction of the first cable and crossing below the first cable. Linearly spaced cable guide rollers are provided on opposite sides of the cable crossing and the second cable passes thereabout. The rollers cause the cable to be moved downwardly from the plane of its path to pass below the first cable and thereafter cause the cable return to move upwardly to the plane of its original path. A pair of engagement elements are secured to the second cable in spaced relationship and engage a crossing dog which has spaced engagement elements on its lower surface for engagement elements on the second cable to effect driving action of the crossing dog by the second cable. The leading one of the engagement elements on the second cable disengages from the crossing dog as the second cable is moved downwardly by the guide rollers while the trailing engagement element remains engaged until it is moved downwardly by the guide rollers. At this time, the leading engaging element reengages the crossing dog as the cable returns to its original path. An engagement member is engaged with the crossing dog and extends upwardly through a slot in the stage deck for engagement with a stage element to be moved, and a power driven second which is provided for moving the second cable and crossing dog in the second path.

Preferably, the rollers are supported in a fixture located below the deck and includes cable guide means guiding the second cable in the fixture about the rollers. The engagement elements on the crossing dog are recesses on its lower surface into which the cable engagement elements seat.

Generally, the assembly includes elongated track members along the paths of the cables providing a channel in which the cable and dogs move and having an opening at their upper end through which the engagement members extend. The cables are endless and there are included sheaves in the paths and about which the cables extend.

The engagement elements on the crossing dog are spaced apart a distance equivalent to the spacing between the engagement elements on the second cable, and the first dog and crossing dogs are spaced on their respective cables so as to preclude their meeting at the crossing. Preferably, the path of the second cable is perpendicular to the path of the first cable.

BRIEF DESCRIPTION OF ATTACHED DRAWINGS

DETAILED DESCRIPTION OF THE ILLUSTRATED EMBODIMENT

Figure 1:
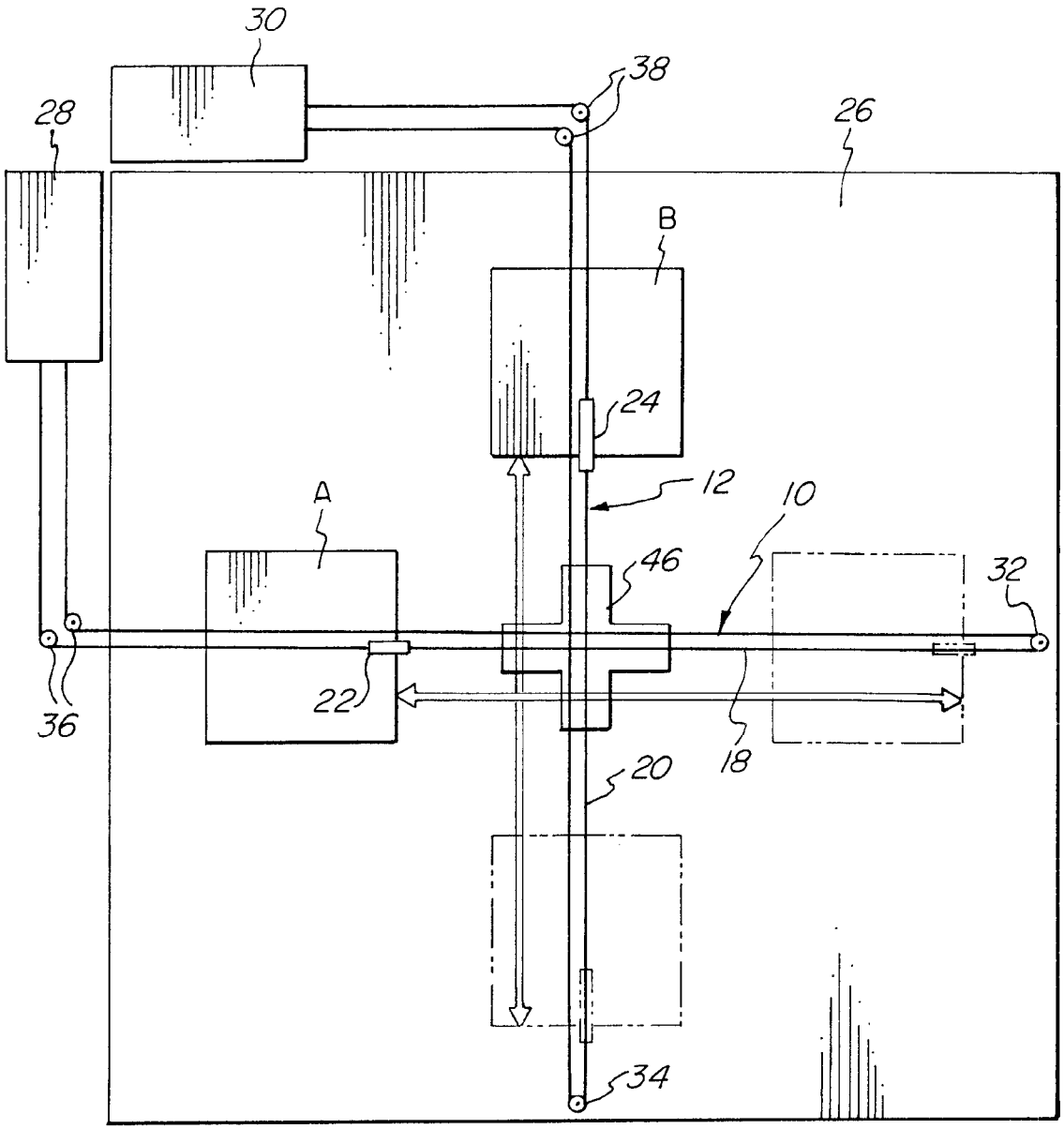
FIG. 1 is a schematic layout of a stage installation embodying the present invention for moving elements of stage scenery and having a pair of crossing tracks.
Figure 2:
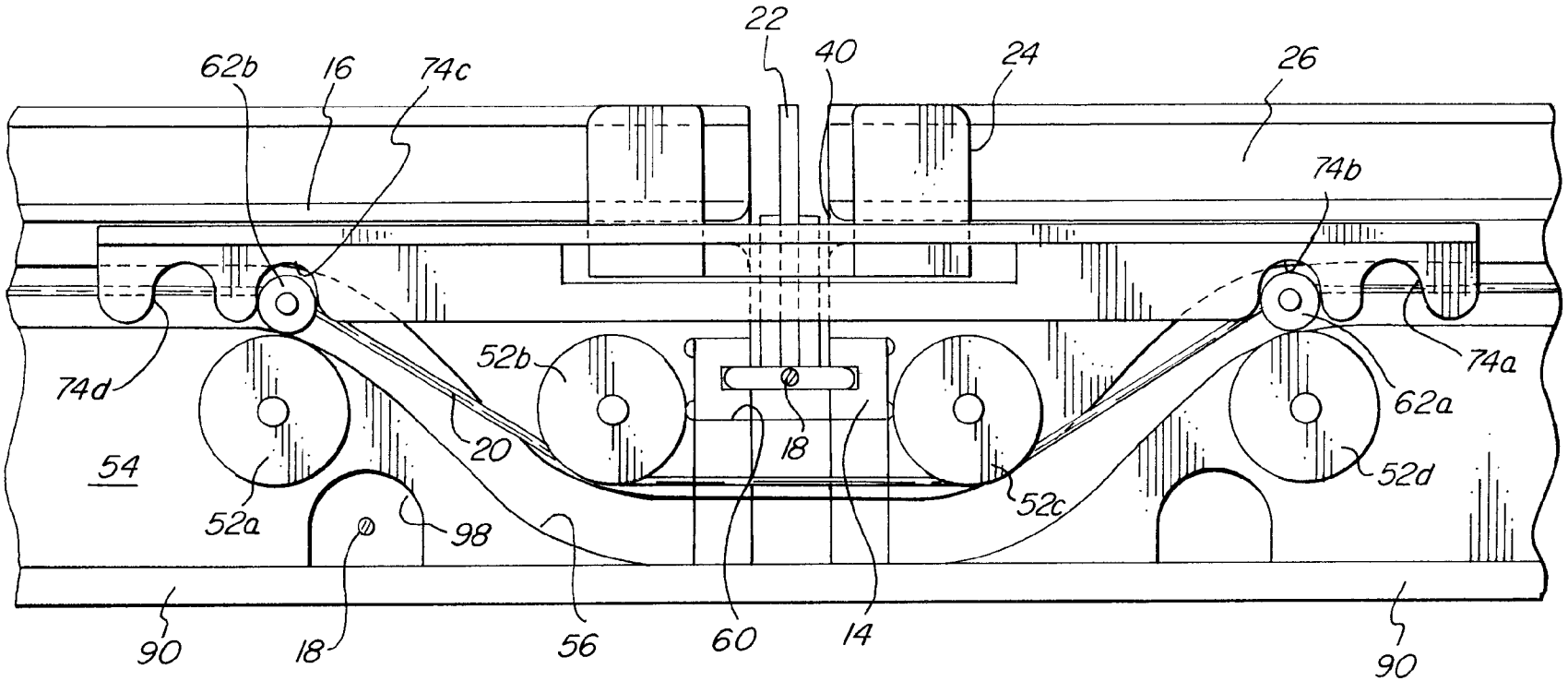
FIG. 2 is a fragmentary side elevational view of the crossing point of the two tracks along the axis of the crossing track omitting stage elements.
Figure 3:
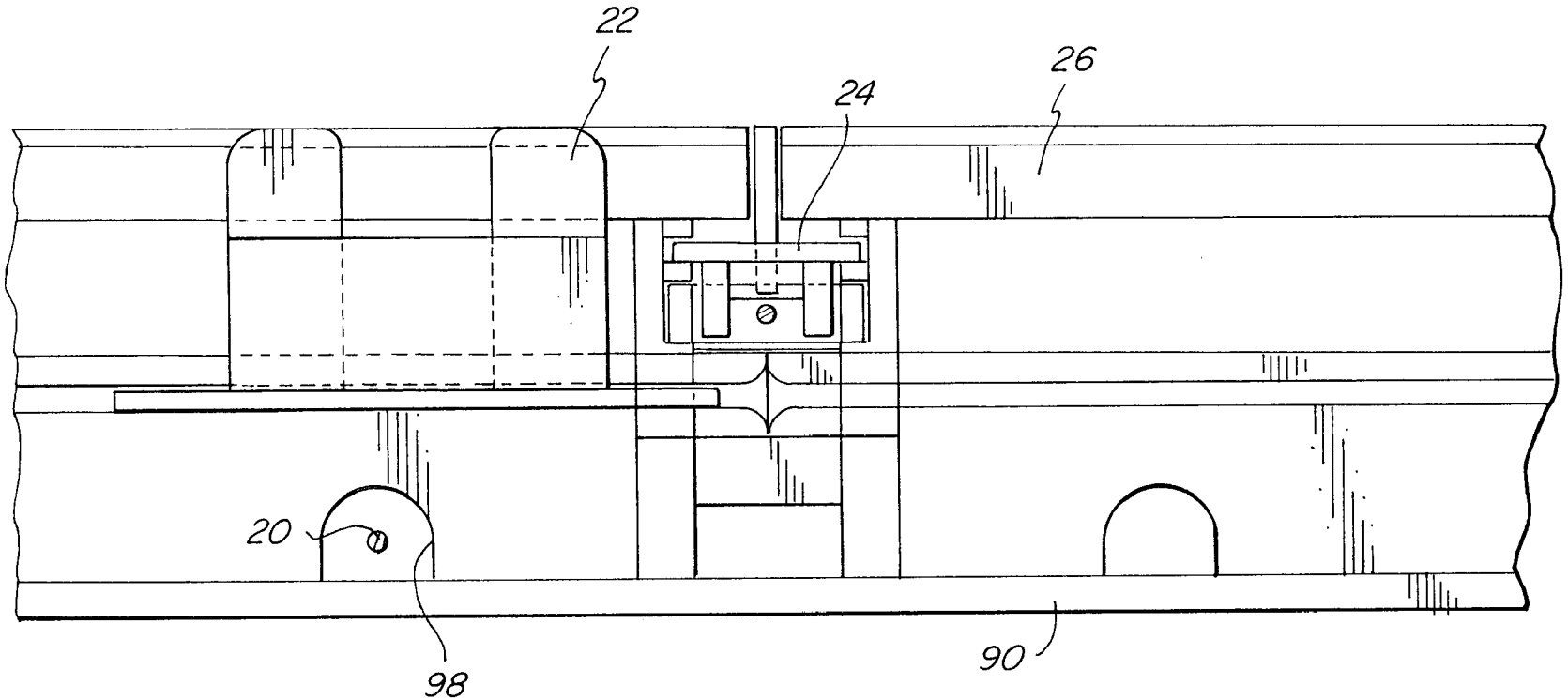
FIG. 3 is a similar view along the other track.
Figure 4:
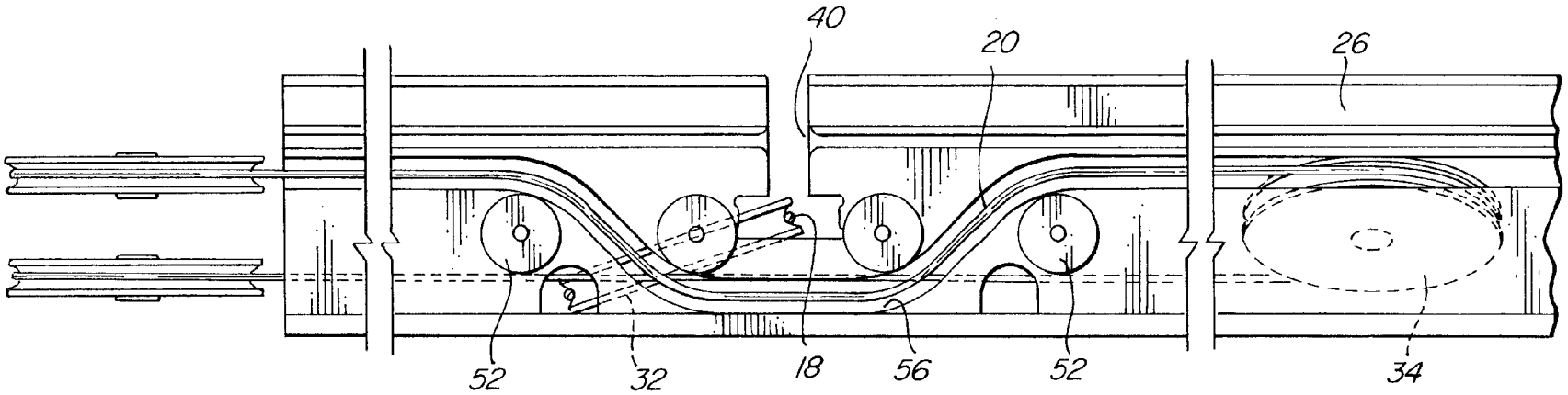
FIG. 4 is a fragmentary view similar to FIG. 2, but omitting the crossing dog and showing the sheaves for the crossing cable.
Figure 5:
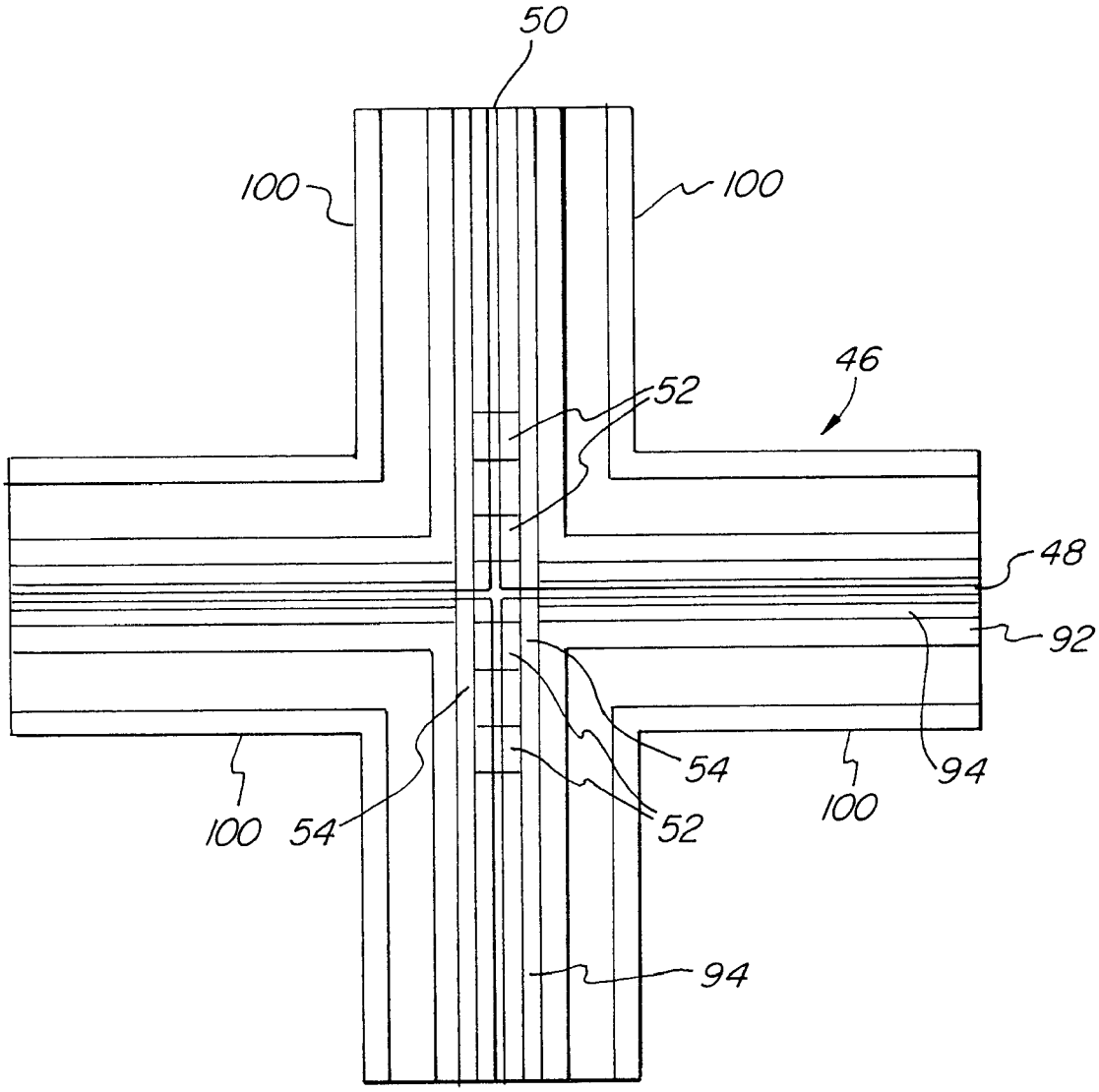
FIG. 5 is a plan view of the track crossing housing.
Figure 6:
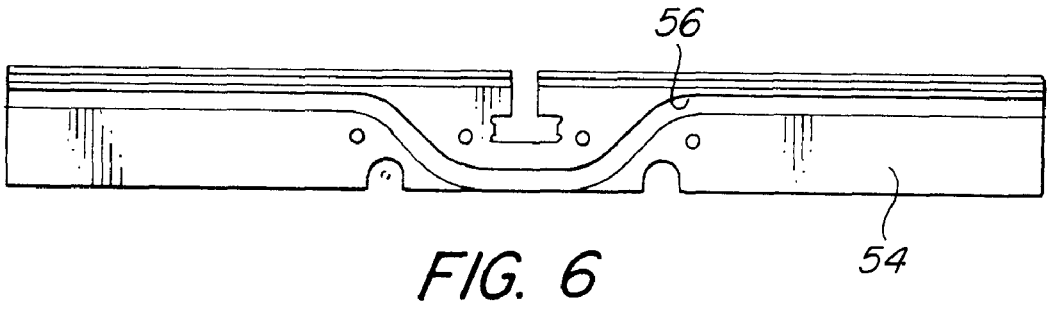
FIG. 6 is a cross sectional view of the housing without the rollers.
Figure 7:
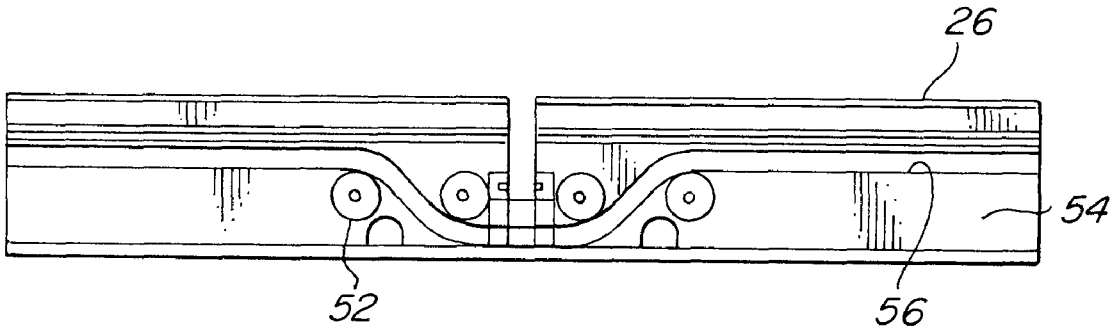
FIG. 7 is a similar view with the rollers installed and showing the main track and deck.
Figure 8:
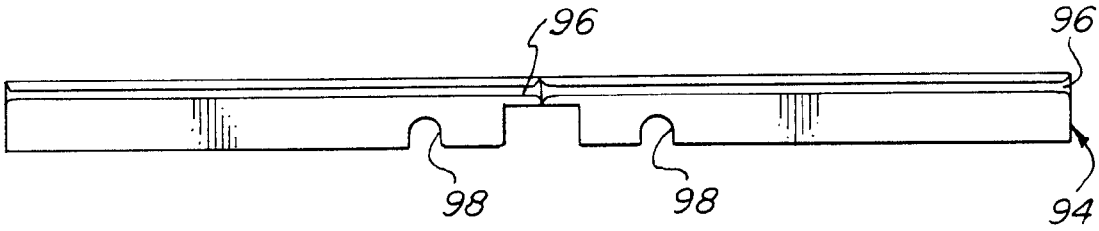
FIG. 8 is a sectional view of the synthetic resin wall in the standard track conduit.
Figure 9:
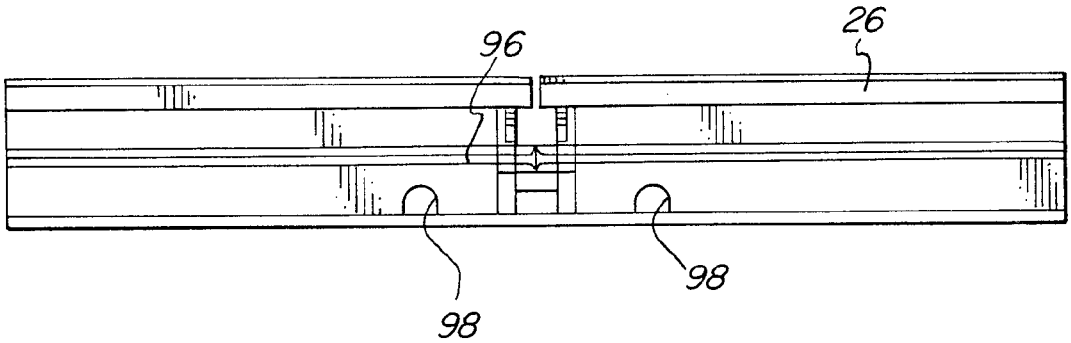
FIG. 9 is a sectional view of the track crossing housing and deck along the line 9—9 of FIG. 5.

Turning first to FIG. 1, therein diagrammatically illustrated is a stage installation in which two stage elements are to be moved in paths generally designated by the numerals in 10, 12 and which are perpendicular to each other. Each path 10, 12 is comprised of conduits, 14, 16 in which are disposed the endless cables 18, 20 which have secured thereto dogs generally designated by the numerals 22, 24. The conduits 14, 16 and crossover housing 46 seat on the permanent stage floor (not shown) and the stage or temporary stage platform deck 26 is installed on the permanent stage about the conduits 14, 16.

Seated in the dogs 22, 24 are blades (not shown) which extend above the stage deck 26 and engage the stage elements A, B. Winches 28, 30 are installed at one end of the cable paths 10, 12 and turnaround sheaves 32, 34 are installed at the other end. Intermediate sheaves 36, 38 may be installed to change the direction of the cables 18, 20 after the path of movement of the stage elements A, B shown by the double headed arrows.

Turning next to FIGS. 2–13, the conduits 14, 16 are generally rectangular in cross-section with a slot 40 in their top wall through which the blades (not shown) extend to engage the stage elements A, B. In the installation of the present invention, a crossing housing generally designated by the numeral 46 is provided and it has slots 48, 50 in its top wall for the blades. In the crossing path a series of rollers 52 *a, b, c, d* is journaled in the side walls 54 of the crossing conduit 16 fixture and a cable bit guide path 56 is milled in the side walls 54 and extends downwardly between the first pair of rollers (52*a*, 52*b*) and upwardly between the second pair 52*c*, 52*d*. The adjacent ends of the side walls 54 are spaced and provided with grooves 60 for travel of the bits and dog 22 on the cable 18.

The conduits 14, 16 are conveniently provided by four lengths of wood providing a base wall 90, side walls 92 and a top wall with the slots 48 or 50 therein. Synthetic resin side plates 94 are secured to the side walls 92 and are formed with guide channels 96 for the bits and dogs on the cables 18, 20. Notches 98 are provided in the side walls 92 and side plates 94 for the return path of the cables 18, 20. The deck 26 is supported on the side walls 92 and top wall of the conduits 14, 16.

The crossing housing or fixture 4 is assembled from a multiplicity of wood members providing conduits as described above as well as structural deck supports 100 extending parallel to and spaced outwardly from the side walls 92. The side walls 92 have synthetic resin side wall elements 54 secured thereto to seat the rollers 52 and formed with guide paths 56 for the bits 62.

Figure 13:
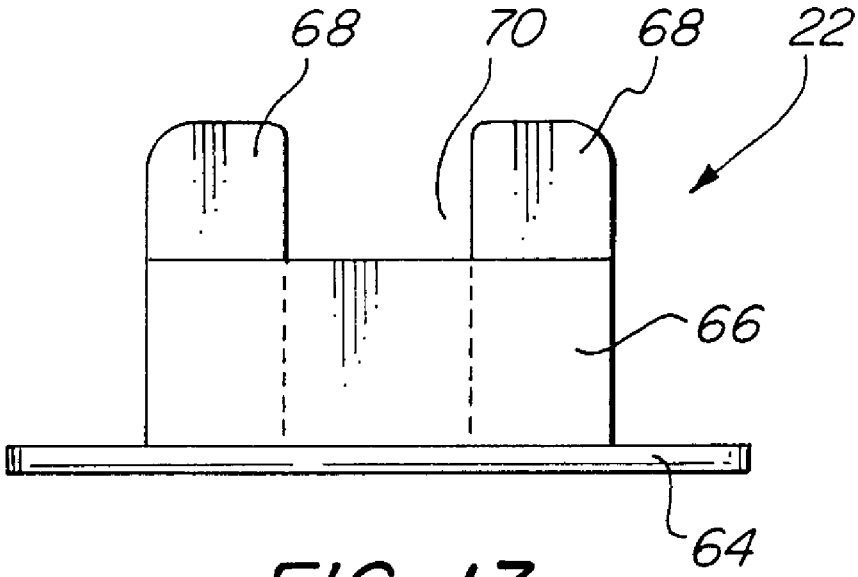
FIG. 13 is a side elevational view of a standard dog.
Figure 14:
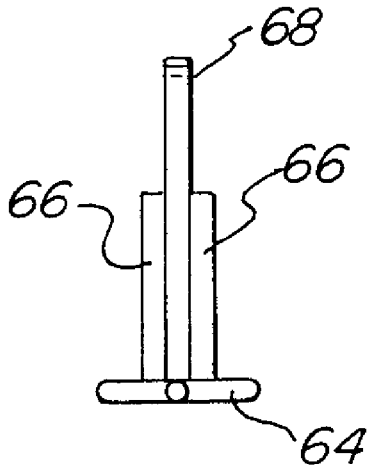
FIG. 14 is an end elevational view thereof.

Turning now to FIGS. 13 and 14, therein illustrated a conventional dog generally designed by the numerical 22 to be secured in position on the cable 18 between cylindrical bits 62. The dog 22 has a base plate 64 spaced sidewalls 66 with end plates 68 providing a recess 70 therebetween to seat the blade (not shown).

Figure 10:
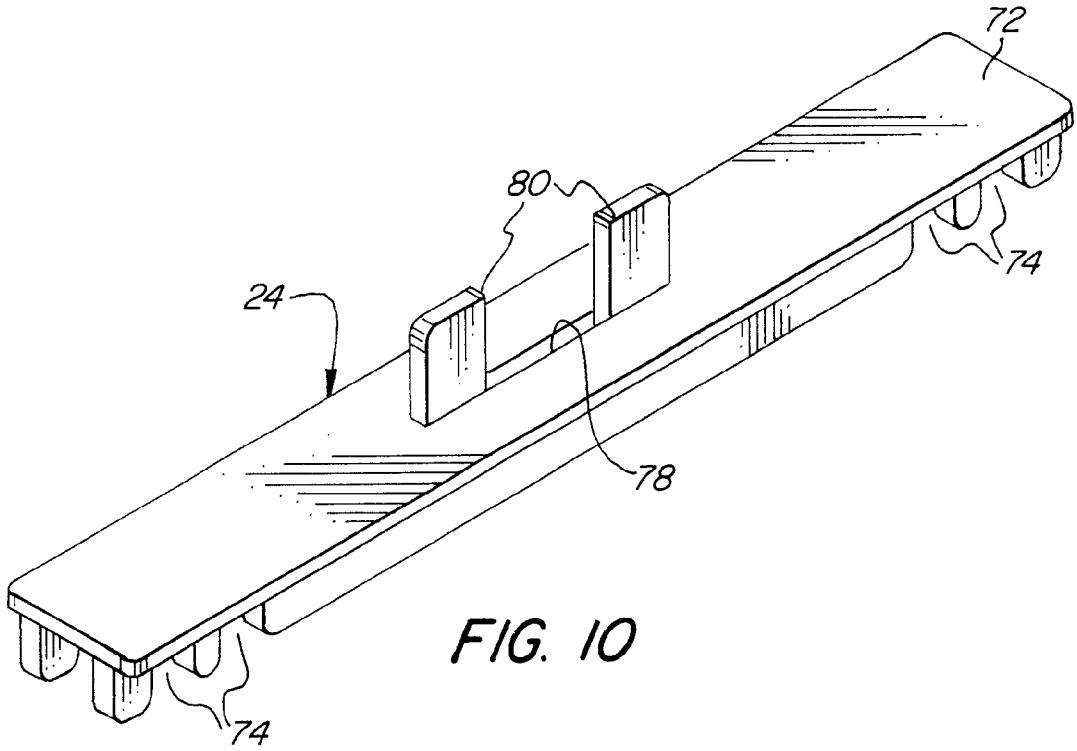
FIG. 10 is a perspective view of the crossing dog.
Figure 11:
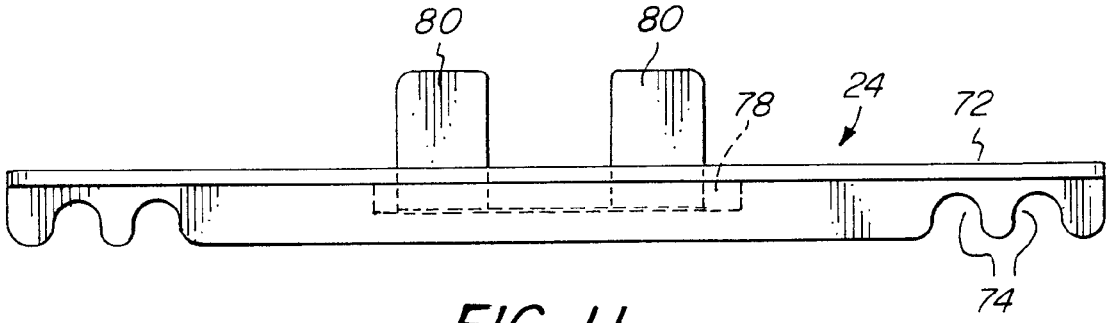
FIG. 11 is a side elevational view thereof.
Figure 12:
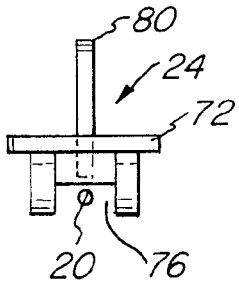
FIG. 12 is an end elevational view thereof.

As seen in FIGS. 10–12, the crossing dog 24 in the present invention comprises a body 72 which has a lower surface with a pair of transverse channels 74 adjacent each thereof, 74 and a longitudinal channel 76. A longitudinal channel 78 is provided in its top surface in which are seated the spaced ears 80 which seat the blade therebetween.

In the operation of the installation, power to the winch 28 will result in movement of the cable 18 and the dog 22. The blade inserted therein will move the stage element A along the main path 10 through the crossing housing 46. The return path of the cable 48 is in a lower plane through the notches 98.

When power is supplied to the winch 30, the cable 20 is moved and the crossover dog 24 is moved by a pair of bits 62*a* and 62*b* which seat in the channels 74*a* and 74*c* in the lower surface thereof. As the dog 24 moves to the crossover point, the leading bit 62*a* and the cable 20 are moved downwardly by the rollers 52*a*, 52*b* and guide path 56 in the side walls 54 while the trailing bit 62*b* remains seated in the channel of the dog 74*c* to effect continued movement of the stage element B. The bit 62*a* and cable 20 pass under the cable 18 which passes thereover and the dog 24 continues to travel in the same plane and passes over the cable 18. The cable 20 and bit 62*a* are then guided upwardly by the rollers 52*c* and 52*d* and guide path 56 until the bit 62*a* engages in the channel 74*b* of the dog 24 to effect the continued movement thereof while the trailing bit 62*b* is moved downwardly in the guide path 56 and then upwardly until it engages in the channel 74*d*.

It can be seen that the plane of travel of the cable 20 is spaced above that for the cable 18, but this is not essential since the cable 20 is displaced downwardly on the cable 18 at the point of crossing.

It should be noted that four recesses or channels are provided in the lower surface of the crossover dog so that the difference in the length of the travel with the cable with the bits thereon in the diverted path can be accommodated. In movement in one direction, the bits are spaced along the length of the cable so that the leading bit is seated in the leading channel in the crossover dog, and the trailing bit is in the third channel in the crossover dog. Because the leading bit travels a longer path than the distance travelled by the crossover dog, the leading bit seats in the second channel, and the trailing bit seats in the fourth channel when it reengages the crossover dog. When the crossover dog is travelling in the reverse direction, the bits will reseat in the original channels.

Although FIG. 1 illustrates only one crossing of intersecting cables, it will be readily appreciated that multiple crossings can be effected at spaced points along the operative length of travel of a cable. It is obviously necessary to control the spacing of the scenery elements as they are moved to ensure that they do not collide at the points of crossing so that the size and the timing must be considered when creating computer software to effect motion automatically or by the operator who in real time transmits signals to the individual winches.

It would be readily appreciated that different constructions can be utilized to form the conduits including integrally molded base and side walls with separate top walls being added. This permits the installation of the rollers and allows maintenance as required. However, the illustrated construction utilizing wood framing elements to provide the bulk of the structural support for the deck and merely fabricating synthetic resin side wall elements providing the guidance for the moving elements is low cost, easy to maintain and quickly serviced. It will be readily appreciated that various modifications can be made in the general construction of the conduits while maintaining the necessary guide rollers and path at the crossover point.

In some instances, the plastic side wall can have channels which slidably seat the side edges of the dogs to facilitate their guidance.

Thus, it can be seen from the foregoing detailed specification and attached drawings that the stage movement assembly of the present invention is one in which the components can be readily and economically fabricated and speedily assembled to provide a stage installation in which tracks may cross in the movement of stage scenery elements. The stage installation utilizing this assembly is quickly erected and easily maintained.

Having thus described the invention, what is claimed is:

1. A stage element movement assembly for location below the surface of a stage deck comprising:

(a) a first cable for disposition in a tunnel below the stage deck and extending in a first path in a first direction;

(b) a first dog secured to said first cable for movement therewith in the tunnel;

(c) an engagement member engaged with said first dog and adapted to extending upwardly through said channel in said stage deck;

(d) a power driven winch for moving said first cable and first dog in said first path;

(e) a second cable for disposition in a tunnel below the stage deck and extending in a second path in a direction at an angle to the direction of said first cable and crossing below said first cable;

(f) spaced cable guide elements on opposite sides of said cable crossing and about which said second cable passes, said guide elements causing said second cable to be moved downwardly from the plane of its path to a level to pass below said first cable and thereafter return to be moved upwardly to the plane of its original path;

(g) a pair of engagement elements secured to said second cable in spaced relationship;

(h) a crossing dog having spaced engagement elements on its lower surface for engagement with said engagement elements on said second cable to effect driving action of said crossing dog by said second cable, the leading one of said engagement elements on said second cable disengaging from said crossing dog as said second cable is moved downwardly by said guide elements while the trailing engagement element remains engaged until it is moved downwardly, said leading engaging element reengaging said crossing dog upon return of the cable to its original path;

(i) an engagement member engaged with said crossing dog and adapted to extend upwardly through a slot in the stage deck for engagement with a stage element to be moved; and (j) a power driven second winch for moving said second cable and crossing dog in said second path.

2. The stage element movement assembly in accordance with claim 1 wherein said guide elements are supported in a crossover member adapted to be located below the deck and wherein there is included cable guide means guiding the second cable in said crossover member about said guide elements.

3. The stage element movement assembly in accordance with claim 1 wherein said engagement elements on said crossing dog are recesses on its lower surface in which said cable engagement elements seat.

4. The stage element movement assembly in accordance with claim 1 wherein there are included elongated track elements along the paths of said cables providing a channel in which said cable and dogs move and having an opening at their upper end through which engagement members extend.

5. The stage element movement assembly in accordance with claim 1 wherein said cables are endless and there are included sheaves in said paths and about which said cables extend.

6. The stage element movement assembly in accordance with claim 1 wherein said engagement elements on said crossing dog are spaced apart a distance equivalent to the spacing between said engagement elements on said cable.

7. The stage element movement assembly in accordance with claim 1 wherein said path of said second cable is perpendicular to the path of said first cable.

8. The stage element movement assembly in accordance with claim 1 wherein said first dog and crossing dogs are spaced along the operative length of their respective cables so as to preclude their meeting at said crossing.

9. In a stage installation, the combination comprising:

(a) a stage deck;

(b) a first cable in a tunnel below said stage deck and extending in a first path in a first direction, said deck having a channel therein providing an opening into said tunnel;

(c) a first dog secured to said first cable for movement therewith in said tunnel;

(d) an engagement member engaged with said first dog and adapted to extending upwardly through said channel in said stage deck;

(e) a first stage element engaged with said first dog;

(f) a power driven winch for moving said first cable and first dog in said first path whereby said first stage element is moved in said stage deck;

(g) a second cable disposed in a second tunnel below said stage deck and extending in a second path in a direction at an angle to the direction of said first cable and crossing below said first cable, said deck having a channel therein providing an opening into said tunnel;

(h) spaced cable guide rollers on opposite sides of said cable crossing and about which said second cable passes, said rollers causing said second cable to be moved downwardly from the plane of its path to a level to pass below said first cable and thereafter return to be moved upwardly to the plane of its original path;

(i) a pair of engagement elements secured to said second cable in spaced relationship;

(j) a crossing dog having spaced engagement elements on its lower surface for engagement with said engagement elements on said second cable to effect driving action of said crossing dog by said second cable, the leading one of said engagement elements on said second cable disengaging from said crossing dog as said second cable is moved downwardly by said guide rollers while the trailing engagement element remains engaged until it is moved downwardly, said leading engaging element reengaging said crossing dog upon return of the cable to its original path;

(k) an engagement member engaged with said crossing dog and adapted to extending upwardly through said channel in said stage deck;

(l) a second stage element engaged with said crossing dog; and (m) a power driven second winch for moving said second cable and crossing dog in said second path whereby said second stage element is moved on said stage deck.

10. The stage installation in accordance with claim 9 wherein said rollers are supported in a fixture adapted to be located below the deck and wherein there is included cable guide means guiding the second cable in said fixture about said rollers.

11. The stage installation in accordance with claim 9 wherein said engagement elements on said crossing dog are recesses on its lower surface into which said cable engagement elements seat.

12. The stage installation in accordance with claim 9 wherein there are included elongated track members along the paths of said cables providing a channel in which said cable and dogs move and having an opening at their upper end through which engagement members extend.

13. The stage installation in accordance with claim 9 wherein said cables are endless and there are included sheaves in said paths and about which said cables extend.

14. The stage installation in accordance with claim 9 wherein said engagement elements on said crossing dog are spaced apart a distance equivalent to the spacing between said engagement elements on said cable.

15. The stage installation in accordance with claim 1 wherein said first dog and crossing dog are spaced on their respective cables so as to preclude their meeting at said crossing.

* * * * *